US008167422B2

(12) United States Patent
Lee

(10) Patent No.: US 8,167,422 B2
(45) Date of Patent: May 1, 2012

(54) HYBRID PRINTING METHOD USING MOVABLE PALLET

(75) Inventor: Sung Hoon Lee, Seoul (KR)

(73) Assignee: Ilsung Mem Co., Ltd. (KR)

( * ) Notice: Subject to any disclaimer, the term of this patent is extended or adjusted under 35 U.S.C. 154(b) by 454 days.

(21) Appl. No.: 12/446,367

(22) PCT Filed: Aug. 30, 2007

(86) PCT No.: PCT/KR2007/004177

§ 371 (c)(1),
(2), (4) Date: Apr. 20, 2009

(87) PCT Pub. No.: WO2008/062939

PCT Pub. Date: May 29, 2008

(65) Prior Publication Data

US 2010/0321452 A1 Dec. 23, 2010

(30) Foreign Application Priority Data

Nov. 23, 2006 (KR) ..... 10-2006-0116265
Nov. 23, 2006 (KR) ..... 20-2006-0030263 U

(51) Int. Cl.
*B41J 2/01* (2006.01)

(52) U.S. Cl. ..... 347/102

(58) Field of Classification Search ..... None
See application file for complete search history.

(56) References Cited

U.S. PATENT DOCUMENTS 4,035,532 A * 7/1977 Gregorian et al. ..... 428/90
2005/0017430 A1 * 1/2005 Takahashi et al. ..... 271/10.01

FOREIGN PATENT DOCUMENTS

| | | |
|---|---|---|
| JP | 61-134256 | 6/1986 |
| JP | 2002-254539 | 9/2002 |
| KR | 1020050077158 | 8/2005 |
| WO | WO 2005/112530 | 11/2005 |

* cited by examiner

*Primary Examiner* — Stephen Meier
*Assistant Examiner* — Alexander C Witkowski
(74) *Attorney, Agent, or Firm* — The Farrell Law Firm, P.C.

(57) ABSTRACT

A hybrid printing method using a movable pallet is provided. The movable pallet is used to apply various desired inks on the surface of fabric products and the like. A printing process, a digital printing process, a multicolor foiling process and a multi-color flocking process provides a variety of designs and colors, dissimilar to the conventional method enabling a simple design and a single color work. The method is not an integral (fixed) type and thus is carried out as a selective work for each individual process, thereby improving productivity by more 100-150% as compared to the conventional facility. The movable pallet is formed of a thin aluminum plate of 3-4 mm thickness to minimize the time required for heating and cooling and to provide for easy attachment and detachment due to its light weight. The pallet is supported on a pallet bracket to avoid bending or distortion.

5 Claims, 4 Drawing Sheets

[Fig. 1]
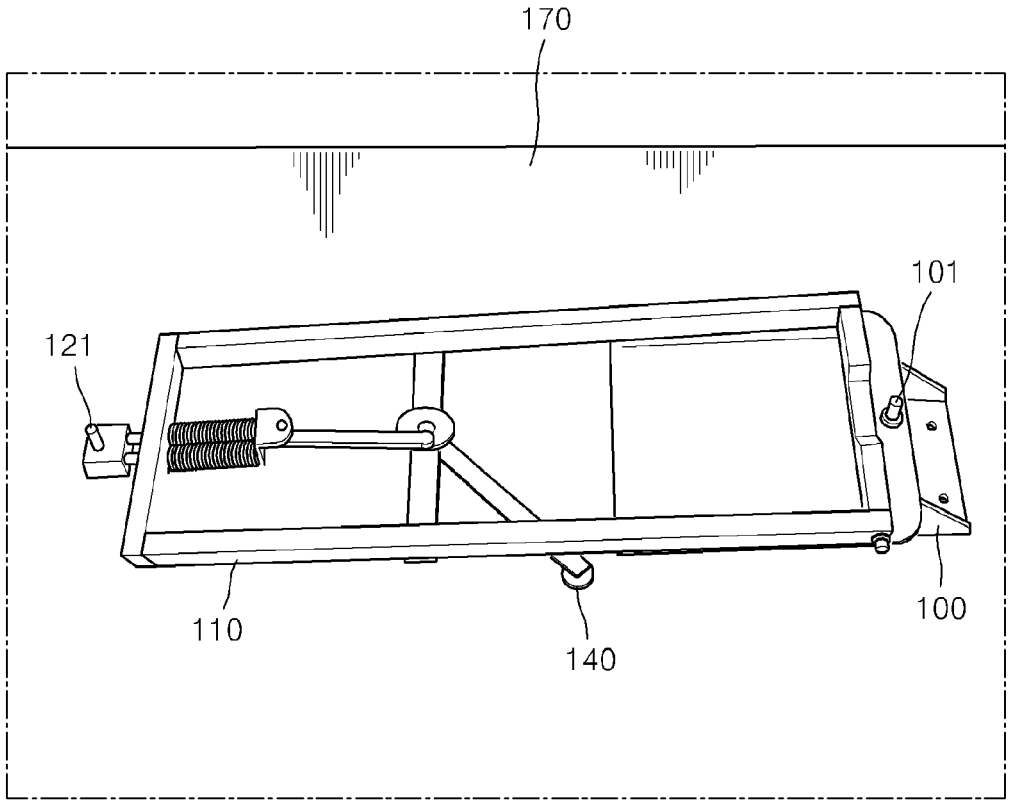
[Fig. 2]
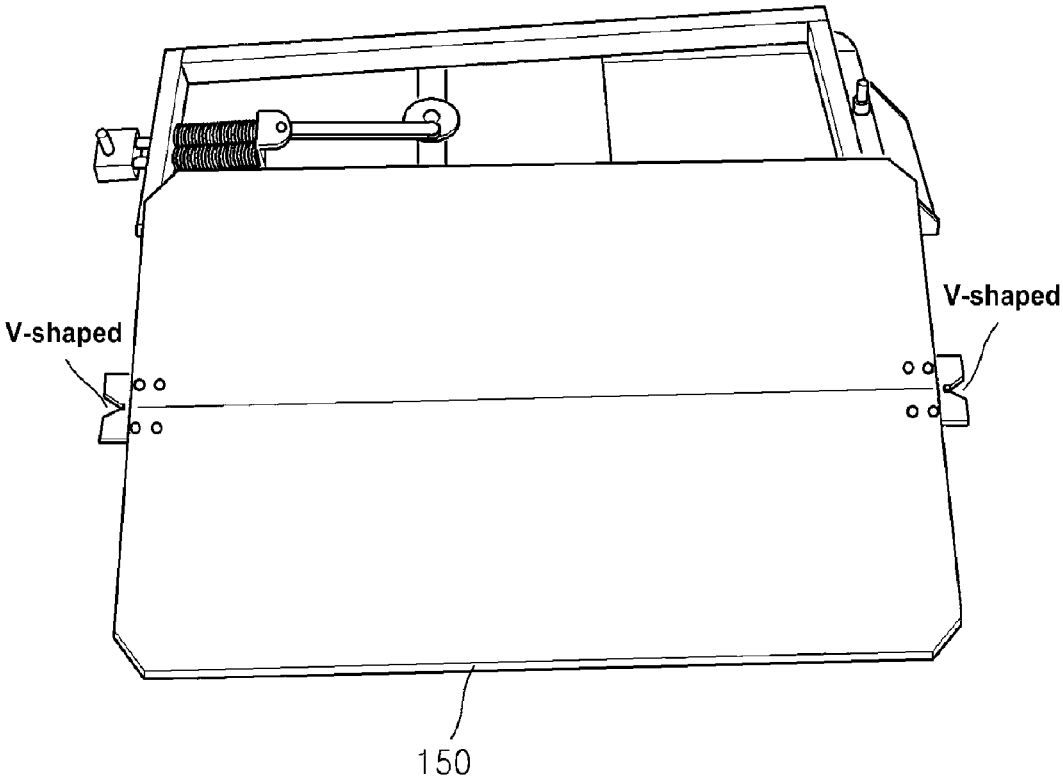

[Fig. 3]
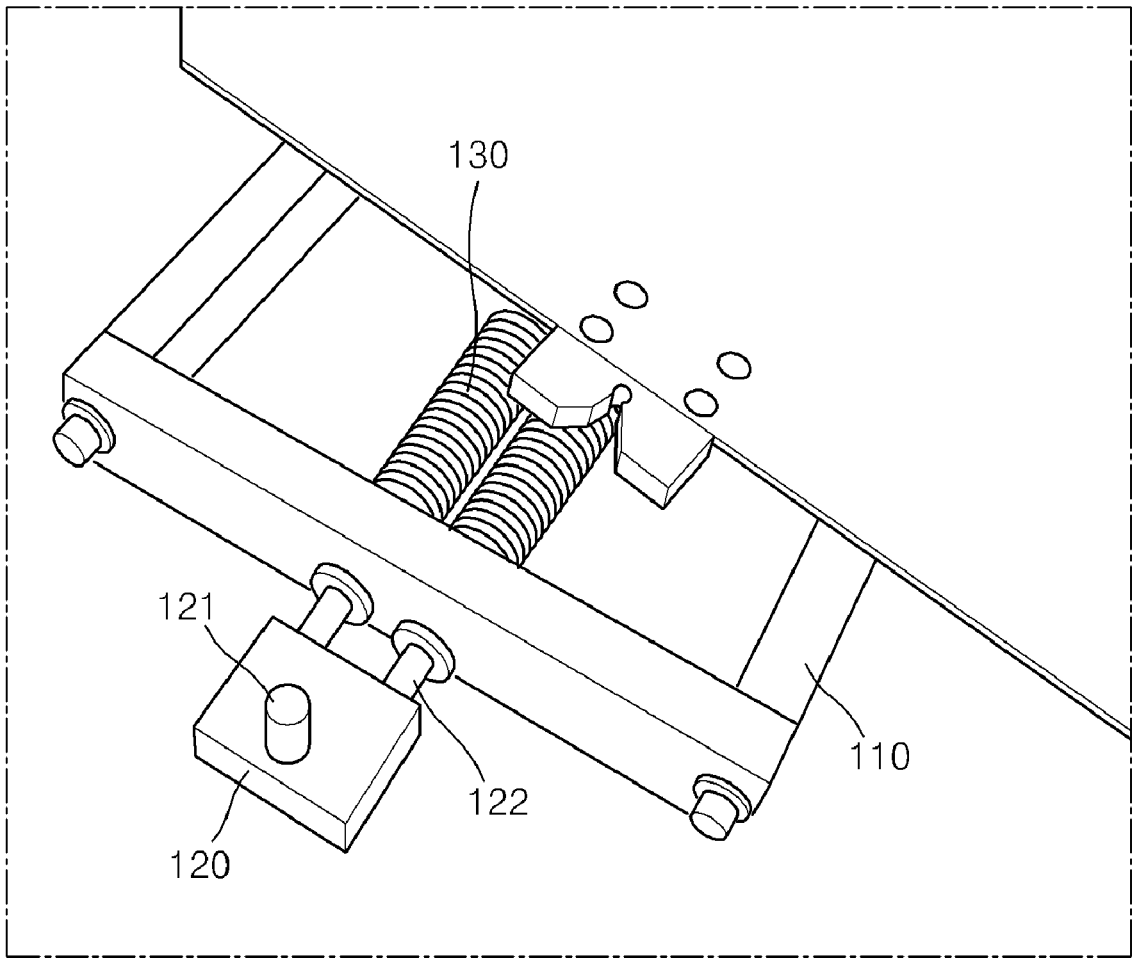

[Fig. 4]
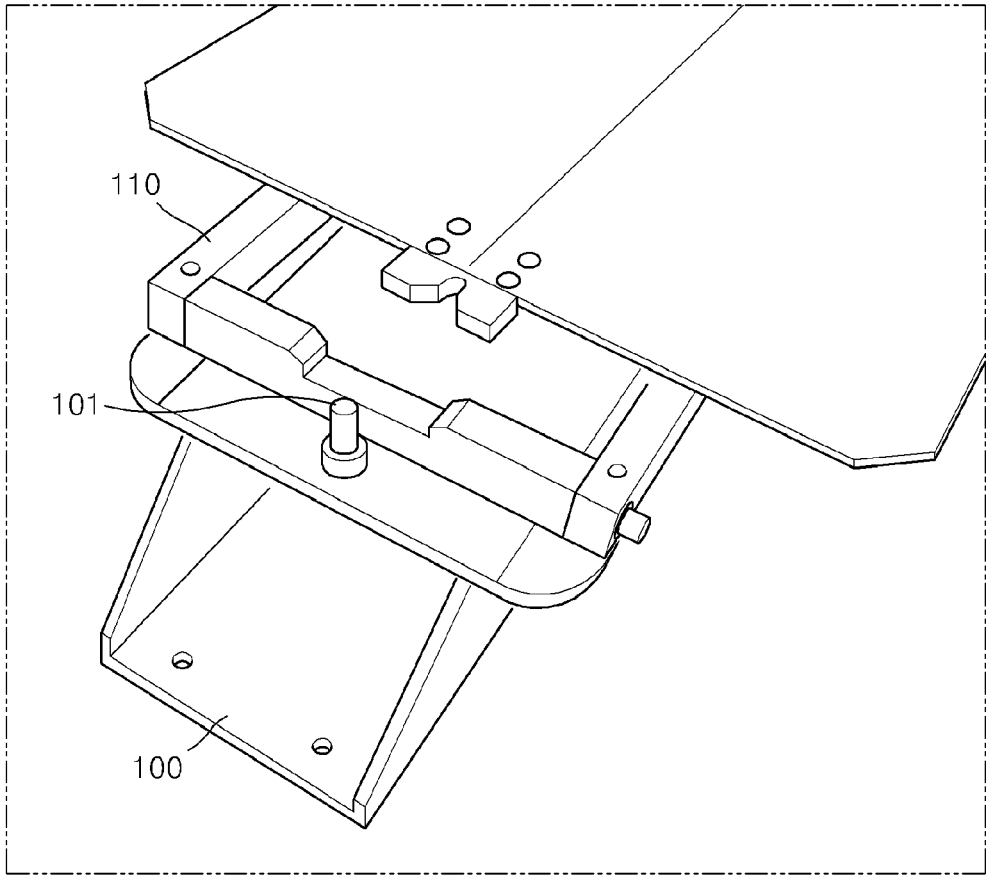
[Fig. 5]
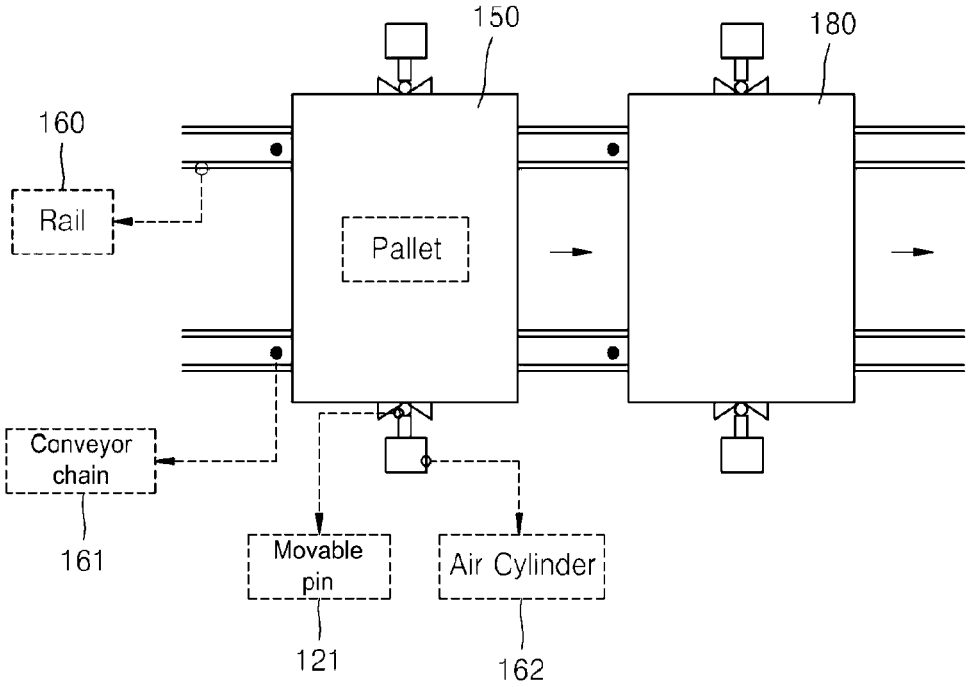

[Fig. 6]
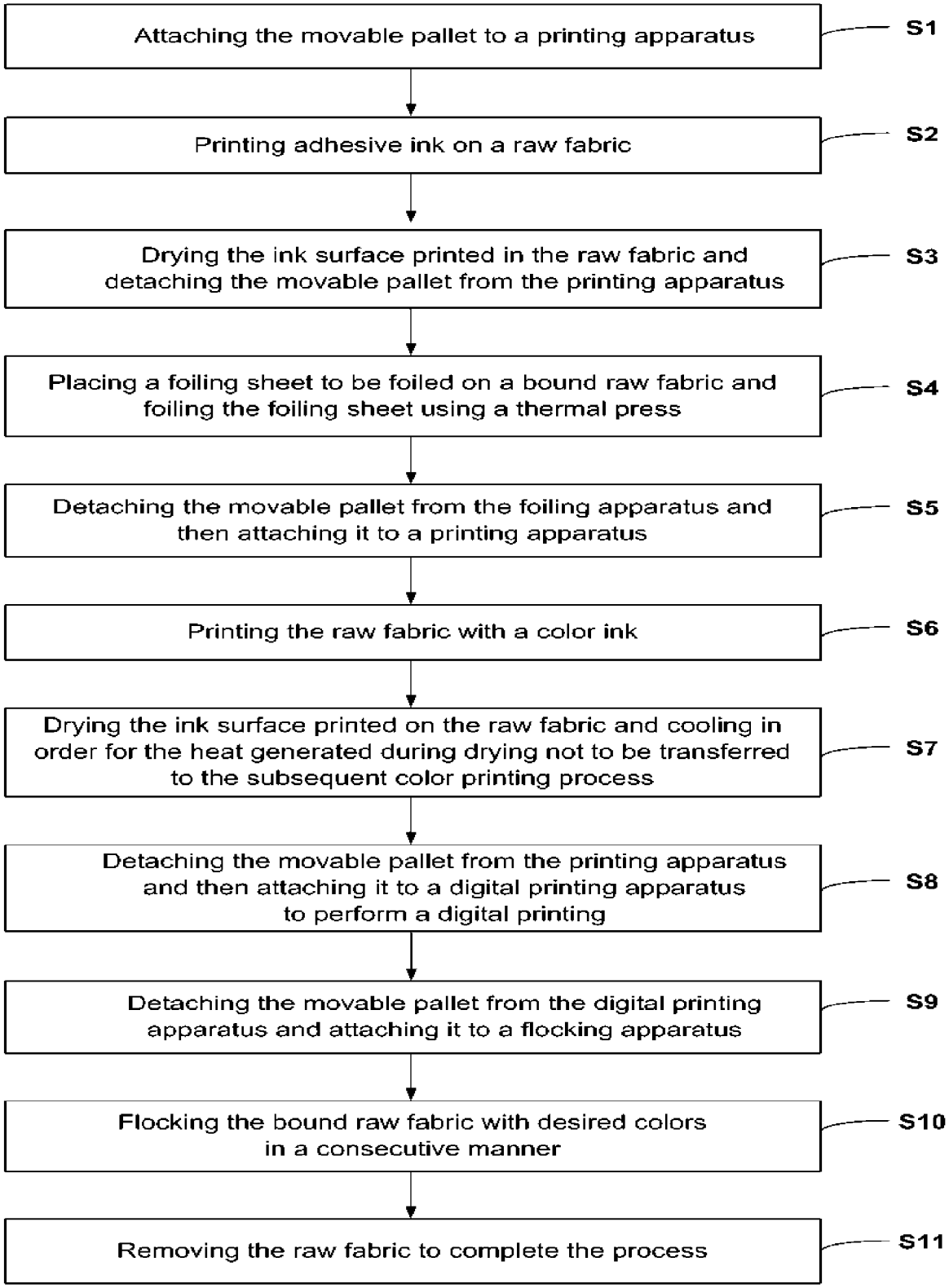

HYBRID PRINTING METHOD USING MOVABLE PALLET

TECHNICAL FIELD

The present invention relates to a hybrid printing method using a movable pallet. More specifically, first, the invention relates to a hybrid printing method using a movable pallet, in which the movable pallet provides for easy attachment and detachment to enable a printing process, a digital printing process, a foiling process and a flocking process. Second, the invention relates to a hybrid printing method using a movable pallet, in which the movable pallet can be used to apply various desired inks on the surface of fabric products and the like. Third, the invention relates to a hybrid printing method using a movable pallet, in which a printing process, a digital printing process, a multi-color foiling process and a multi-color flocking process can be enabled to provide for a variety of designs and colors, dissimilar to the conventional method enabling a simple design and a single color work. Fourth, the invention relates to a hybrid printing method using a movable pallet, in which the process is carried out with the pile put into a box and tightly contact at the top and bottom thereof and therefore the pile is not scattered into the atmosphere, thereby enabling to maintain a comfortable working environment, unlike the conventional process in which a pile is to be sprayed from the top to the bottom during the flocking process and thus a fine pile is scattered into the atmosphere to contaminate the environment of the workplace. Fifth, the invention relates to a hybrid printing method using a movable pallet, which is not an integral (fixed) type and thus can be carried out in a selective manner for each individual process, thereby improving the productivity by more than 100-150% as compared to the conventional facility. Sixth, the invention relates to a hybrid printing method using a movable pallet, in which the movable pallet is formed of a thin aluminum plate of 3-4□ thickness to minimize the time required for heating and cooling and to provide for easy attachment and detachment due to its light weight, and the pallet is supported on a pallet bracket to thereby avoid bending or distortion.

BACKGROUND ART

In the conventional fabric printing machine, a pallet holding a raw fabric (a workpiece to be printed) is configured to be fixed to a mechanical structure and transferred, thereby enabling a printing job only. With the fixed pallet machine being used currently, the design capability is extremely restricted and its productivity is significantly lowered, thereby leading to an increase in the production cost and thus difficulties in the sale thereof. A hybrid process (combined flocking and printing) can be characterized as follows. In order to carry out a multi-color printing in a consecutive manner, the pallet necessarily requires a proper heat of 100 to 120° C. When a binding process for flocking is performed, the pallet must be properly cooled (below 30° C.). The reasons are that in order for the consecutive printing to be successfully performed, a previously printed ink must be dried (at the drying temperature of 160 to 180° C.) before a subsequent color printing. In case of the flock binder, if the pallet has a heat, a film is formed in the surface of the binder and thus the flocking cannot be easily accomplished. This will result decisively in a reduction in the productivity and quality degradation.

Conventionally, the pallet is formed of an aluminum plate of 12 to 15□ thickness or an aluminum cast in order to prevent bending or distortion. Thus, it disadvantageously takes much time to heat up and cool the pallet. In particular, with the conventional process, a multi-color printing can be carried out to a certain degree (without considering the productivity), but a multi-color flocking cannot be performed. This is because its quality is extremely degraded, along with its decreased productivity.

Besides the above serious problems, i.e., the degradation in the productivity and quality due to repetitive heating and cooling of the pallet and the limited design capability, various other problems exist. In the flocking process, remaining pile is scattered into the atmosphere and thus the entire factory can be contaminated. Therefore, it adversely affects all the products under fabrication and incurs very serious problems with the working environment.

In case of the conventional downward flocking process, a large amount of pile remains, except for the flocked piles. However, there exists no way to recover the remaining pile. Even though a separate removing facility or process can be added, the scattering of the remaining pile cannot easily be prevented.

DISCLOSURE OF INVENTION

Technical Problem

Accordingly, the present invention has been made in an effort to solve the problems occurring in the prior art. It is an object of the invention to provide a hybrid printing method using a movable pallet, in which the movable pallet provides for easy attachment and detachment to enable a printing process, a digital printing process, a foiling process and a flocking process.

Another object of the invention is to provide a hybrid printing method using a movable pallet, in which the movable pallet can be used to apply various desired inks on the surface of fabric products and the like.

Another object of the invention is to provide a hybrid printing method using a movable pallet, in which a printing process, a digital printing process, a multi-color foiling process and a multi-color flocking process can be enabled to provide for a variety of designs and colors, dissimilar to the conventional method enabling a simple design and a single color work.

Another object of the invention is to provide a hybrid printing method using a movable pallet, in which the process is carried out with the pile put into a box and tightly contact at the top and bottom thereof and therefore the pile is not scattered into the atmosphere, thereby enabling to maintain a comfortable working environment, unlike the conventional process in which a pile is to be sprayed from the top to the bottom during the flocking process and thus a fine pile is scattered into the atmosphere to contaminate the environment of the workplace.

Another object of the invention is to provide a hybrid printing method using a movable pallet, which is not an integral (fixed) type and thus can be carried out in a selective manner for each individual process, thereby improving the productivity by more than 100-150% as compared to the conventional facility.

Another object of the invention is to provide a hybrid printing method using a movable pallet, in which the movable pallet is formed of a thin aluminum plate of 3-4□ thickness to minimize the time required for heating and cooling and to provide for easy attachment and detachment due to its light weight, and the pallet is supported on a pallet bracket to thereby avoid bending or distortion.

Technical Solution

In order to accomplish the above object, according to an aspect of the invention, there is provided a hybrid printing method using a movable pallet, the method comprising the steps of: attaching the movable pallet to a printing apparatus; printing an adhesive ink on a raw fabric for purpose of foiling (binding step); drying the surface of the ink printed on the raw fabric; detaching the movable pallet from the printing apparatus; placing and thermal-pressing a foil sheet on the bound raw fabric (foiling step); detaching the movable pallet from the foiling apparatus and then attaching the movable pallet to the printing apparatus; printing the raw fabric using various inks (printing step); drying and cooling the printed raw fabric; detaching the movable pallet from the printing apparatus and then attaching the movable pallet to a digital printing apparatus (digital printing step); detaching the movable pallet from the digital printing apparatus and then attaching the movable pallet to a flocking apparatus; printing an adhesive ink on the raw fabric for purpose of flocking (binding step); flocking the bound raw fabric with desired colors in a consecutive manner; and removing the raw fabric to complete the process.

In the above method, the foiling, printing, digital printing and flocking processes may be carried out in a single or plural numbers.

In the above method, in order to print multiple colors with the foiling process, a binding process is performed by the number of times corresponding to the number of colors and a press process is carried out to make a multiplicity of colors, and the flocking process includes the step of binding one time and then automatically flocking into multiple colors.

In the above method, the movable pallet includes: a pallet support having a function of supporting the movable pallet using a fixing pin fastened to one side in the upper side of a fixed bracket; a pin holder provided in the central portion of the pallet support at the opposite side to where the fixed bracket is fastened, the pin holder having a movable pin protrudingly fixed on the top thereof and a forward-and-backward driver pin formed in the side face thereof in order to move a drive pin in a forward and backward direction; a spring for pushing the movable pin when a pallet is being fixed, the forward-and-backward driver pin passing through the pallet support so as to be combined with the spring; and a lever assembly linked with the spring, the lever assembly firmly fixing the movable pallet by closely contacting with a V-shaped groove formed in the movable pallet at the side of the movable pin.

In the above method, a V-shaped groove is formed at both sides of the movable pallet to thereby minimize the weight and facilitate attachment and detachment, and the fixed pin and movable pin are provided to support the movable pallet and the pallet support on the V-shaped groove of the movable pallet.

In the above method, the movable pallet is transferred in parallel by means of a rail and a conveyor chain without a bracket, dissimilar to a rotary type machine where a turntable is fixed by a bracket and an arm, and after the movable pallet is moved to a desired position, the movable pin at both sides operates by means of an air cylinder and then the pallet is fixed in an accurate position by the V-shaped groove formed in the movable pallet.

Advantageous Effects

As described above, according to the present invention, first, the movable pallet provides for easy attachment and detachment to enable a printing process, a digital printing process, a foiling process and a flocking process. Second, the movable pallet can be used to apply various desired inks on the surface of fabric products and the like. Third, a printing process, a digital printing process, a multi-color foiling process and a multi-color flocking process can be enabled to provide for a variety of designs and colors, dissimilar to the conventional method enabling a simple design and a single color work. Fourth, the process is carried out with the pile put into a box and tightly contact at the top and bottom thereof and therefore the pile is not scattered into the atmosphere, thereby enabling to maintain a comfortable working environment, unlike the conventional process in which a pile is to be sprayed from the top to the bottom during the flocking process and thus a fine pile is scattered into the atmosphere to contaminate the environment of the workplace. Fifth, the process is not an integral (fixed) type and thus can be carried out a selective work for each individual process, thereby improving the productivity by more than 100-150% as compared to the conventional facility. Sixth, the movable pallet is formed of a thin aluminum plate of 3-4□ thickness to minimize the time required for heating and cooling and to provide for easy attachment and detachment due to its light weight, and the pallet is supported on a pallet bracket to thereby avoid bending or distortion.

BRIEF DESCRIPTION OF THE DRAWINGS

FIG. 1 is a top plan view illustrating a movable pallet bracket according to an embodiment of the invention;

FIG. 2 shows the appearance of a movable pallet according to an embodiment of the invention where the movable pallet is placed on the bracket;

FIG. 3 is a detailed view showing a pallet support and a pin holder according to an embodiment of the invention;

FIG. 4 shows a combined state of a pallet support, a fixing pin and a bracket according to an embodiment of the invention;

FIG. 5 shows a movable pallet being combined according to another embodiment of the invention; and FIG. 6 is a flow chart showing a hybrid printing process using a movable pallet according to an embodiment of the invention.

MODE FOR THE INVENTION

Hereinafter, exemplary embodiments of the invention will be explained in details with reference to the accompanying drawings. In the description, details on well-known features and techniques may be omitted to avoid unnecessarily obscuring the invention. The words and phrases used herein have been defined considering functions of the invention and may be interpreted differently according to the intentions and customs of users and operators. Thus, their meanings should be interpreted, considering the whole description explaining the present invention entitled a hybrid printing method using a movable pallet.

FIG. 1 is a top plan view illustrating a movable pallet bracket according to an embodiment of the invention. FIG. 2 shows the appearance of a movable pallet according to an embodiment of the invention where the movable pallet is placed on the bracket. FIG. 3 is a detailed view showing a pallet support and a pin holder according to an embodiment of the invention. FIG. 4 shows a combined state of a pallet support, a fixing pin and a bracket according to an embodiment of the invention.

Referring to FIGS. 1 to 4, a movable pallet bracket 170 is placed on the top of a fixed bracket 100, in which a fixing pin 101 is installed so as to protrude in order to combine it to the pallet jig of a fabric printing machine capable of printing, flocking and foiling. The movable pallet bracket 170 includes a pallet support 110, a pin holder 120, a spring 130 and a lever assembly 140. A fixing pin is provided at one side on the top of the fixed bracket 100 and thus the pallet support 110 supports a movable pallet. The pin holder 120 is installed in the central portion of the pallet support 110 at the opposite side to where the fixed bracket 100 is provided. A movable pin 121 is fixed on the top of the pin holder 120 so as to protrude. Fixedly formed at the side of the pin holder 120 is a forward-and-backward drive pin 122 for moving a drive pin in forward and backward direction. The forward-and-backward drive pin 122 gets through the pallet support 110 and is combined with the spring 130. The spring 130 pushes the movable pin 121 when the pallet 150 is to be fixed. The lever assembly 140 is linked with the spring. The lever assembly 140 is configured such that the movable pallet is firmly fixed by the spring while being closely contacted with a V-shaped groove formed in the movable pallet 150 to the direction of the movable pin 121.

Major technical means of the movable pallet bracket according to an embodiment of the invention will be explained, referring to FIGS. 1 to 4.

The pallet support 110 is rested on the top of the fixed bracket 100, in which the fixing pin 101 is installed so as to protrude in order to combine it to the pallet jig of a fabric printing machine capable of printing, flocking and foiling. The pallet support 110 functions to support the movable pallet since a fixing pin is fastened at one side on the top of the fixed bracket 100.

The pin holder 120 is fastened to the central portion of the pallet support 110 at the opposite site to where the fixed bracket 100 is fastened. A movable pin 121 is protrudingly provided on the top of the pin holder 120. Fixedly formed at the side of the pin holder 120 is a forward-and-backward drive pin 122 for moving a drive pin in the forward and backward direction. Here, the movable pin 121 moves to the left and right to facilitate attachment and detachment and enable to be fixed in the right position.

The forward-and-backward drive pin 122 gets through the pallet support 110 and is combined with the spring 130. The spring 130 plays a role to push the movable pin 121 when the pallet 150 is being fixed.

The lever assembly 140 is linked with the spring. The movable pin 121 is closely contacted with the V-shaped groove formed in the movable pallet 150. The lever assembly 140 functions in order for the spring to firmly fix the movable pallet.

Formed at both sides of the movable pallet is a V-shaped groove, which minimizes the weight and facilitates attachment and detachment. Since the fixed pin and movable pin both are co-operated, they support the movable pallet and the pallet support on the V-shaped groove of the movable pallet.

As described above, the movable pallet bracket can be used in all types of fabric printing machines. The pallet is configured to be fixed to a rotational body of machine using a fixing member (bolt) and thus to rotate or move. It is structured so as to be easily attached and detached, escaping from the concept of a fixed pallet. Therefore, attachment and detachment of the pallet can be easily carried out, and foiling or flocking work can be performed while printing job is being done.

FIG. 5 shows a movable pallet being combined according to another embodiment of the invention.

In the movable pallet bracket 170, the movable pallet has the same structure. However, dissimilar to a rotary type machine where a turntable is fixed by a bracket and an arm, the movable pallet is transferred in parallel by means of a rail and a conveyor chain, without a bracket. After the movable pallet is moved to a desired position, the movable pin at both sides operates by means of an air cylinder and then the pallet is fixed in an accurate position by the V-shaped groove formed in the movable pallet.

FIG. 6 is a flow chart showing a hybrid printing process using a movable pallet according to an embodiment of the invention.

Referring to FIG. 6, the hybrid printing process using a movable pallet according to an embodiment of the invention will be explained. First, at step S1, the movable pallet is attached to a printing machine. Subsequently, at step S2, for purpose of foiling, an adhesive ink is printed on a raw fabric. Then, at step S3, the surface of the ink printed on the raw fabric is dried and the movable pallet is detached from the printing machine. Upon completion of the step S3, at step S4, a foil sheet for foiling is placed on the bound raw fabric and then a thermal press is performed to do foiling. After the thermal pressing work, the remaining foil must be removed after cooling.

At the next step S5, the movable pallet is removed from the foiling apparatus and attached to a printing apparatus. In case of the movable pallet, a rotary type is to be attached and detached by using a fixing member and a parallel transfer type is attached and detached by unloading it. In addition, when it is attached, the rotary type is to be attached by tightening the fixing member and the parallel transfer type is to be attached by simply loading on the top of it.

Thereafter, at step S6, a color ink is printed on the raw fabric. At subsequent step S7, the surface of the ink printed on the raw fabric is dried, and a cooling is carried out so as not to transfer the drying heat to the next color printing. At step S8, the movable pallet is removed from the printing apparatus and attached to a digital printing apparatus to perform a digital printing. Then, at step S9, the movable pallet is detached from the digital printing apparatus and attached to a flocking apparatus. At the subsequent step S10, a flocking is carried out with desired colors on the bound raw fabric in consecutive manner. At step S11, the raw fabric is removed to complete the process.

The above work process is carried out in the order of foiling, printing, digital printing and flocking. However, except for the order of foiling and flocking, other work steps can be switched with freedom. The foiling, printing, digital printing and flocking process can be selected in a single or plural numbers. Furthermore, in order to print in multiple colors using the foiling and flocking processes, the binding steps can be performed in the number of colors to be printed.

Industrial Applicability

As described above, according to the present invention, first, the movable pallet provides for easy attachment and detachment to enable a printing process, a digital printing process, a foiling process and a flocking process. Second, the movable pallet can be used to apply various desired inks on the surface of fabric products and the like. Third, a printing process, a digital printing process, a multi-color foiling process and a multi-color flocking process can be enabled to provide for a variety of designs and colors, dissimilar to the conventional method enabling a simple design and a single color work. Fourth, the process is carried out with the pile put into a box and tightly contact at the top and bottom thereof and therefore the pile is not scattered into the atmosphere, thereby enabling to maintain a comfortable working environment, unlike the conventional process in which a pile is to be sprayed from the top to the bottom during the flocking process and thus a fine pile is scattered into the atmosphere to contaminate the environment of the workplace. Fifth, the process is not an integral (fixed) type and thus can be carried out a selective work for each individual process, thereby improving the productivity by more 100-150% as compared to the conventional facility. Sixth, the movable pallet is formed of a thin aluminum plate of 3-4□ thickness to minimize the time required for heating and cooling and to provide for easy attachment and detachment due to its light weight, and the pallet is supported on a pallet bracket to thereby avoid bending or distortion.

Although the present invention has been described with reference to several embodiments of the invention, the description is illustrative of the invention and is not to be construed as limiting the invention. Various modifications and variations may occur to those skilled in the art, without departing from the spirit and scope of the invention as defined by the appended claims.

The invention claimed is:

1. A hybrid printing method using a movable pallet, the method comprising the steps of:

attaching the movable pallet to a printing apparatus;

printing an adhesive ink on a raw fabric for purpose of foiling (binding step);

drying the surface of the ink printed on the raw fabric;

detaching the movable pallet from the printing apparatus;

placing a foil sheet on the bound raw fabric and foiling the foil sheet using a thermal-press;

detaching the movable pallet from the foiling apparatus and then attaching the movable pallet to the printing apparatus;

printing the raw fabric using various inks (printing step);

drying and cooling the printed raw fabric;

detaching the movable pallet from the printing apparatus and attaching the movable pallet to a digital printing apparatus (digital printing step);

detaching the movable pallet from the digital printing apparatus and attaching the movable pallet to a flocking apparatus;

printing an adhesive ink on the raw fabric for purpose of flocking (binding step);

flocking the bound raw fabric with desired colors in a consecutive manner; and removing the raw fabric to complete the process, wherein the movable pallet includes: a pallet support having a function of supporting the movable pallet using a fixing pin fastened to one side in the upper side of a fixed bracket; a pin holder provided in the central portion of the pallet support at the opposite side to where the fixed bracket is fastened, the pin holder having a movable pin protrudingly fixed on the top thereof and a forward-and-backward driver pin formed in the side face thereof in order to move a drive pin in a forward and backward direction; a spring for pushing the movable pin when a pallet is being fixed, the forward-and-backward driver pin passing through the pallet support so as to be combined with the spring; and a lever assembly linked with the spring, the lever assembly firmly fixing the movable pallet by closely contacting with a V-shaped groove formed in the movable pallet at the side of the movable pin.

2. The method according to claim 1, wherein the foiling, printing, digital printing and flocking processes are carried out in a single or plural numbers.

3. The method according to claim 1, wherein in order to print multiple colors with the foiling process, a binding process is performed by the number of times corresponding to the number of colors and a press process is carried out to make a multiplicity of colors, and the flocking process includes the step of binding one time and then automatically flocking into multiple colors.

4. The method according to claim 1, wherein a V-shaped groove is formed at both sides of the movable pallet to thereby minimize the weight and facilitate attachment and detachment, and the fixed pin and movable pin are provided to support the movable pallet and the pallet support on the V-shaped groove of the movable pallet.

5. The method according to claim 1, wherein the movable pallet is transferred in parallel by means of a rail and a conveyor chain without a bracket, dissimilar to a rotary type machine where a turntable is fixed by a bracket and an arm, and after the movable pallet is moved to a desired position, the movable pin at both sides operates by means of an air cylinder and then the pallet is fixed in an accurate position by the V-shaped groove formed in the movable pallet.

* * * * *